US009488175B2

(12) United States Patent
Akatsuka et al.

(10) Patent No.: US 9,488,175 B2
(45) Date of Patent: Nov. 8, 2016

(54) VARIABLE CAPACITY TYPE VANE PUMP

(71) Applicant: KAYABA INDUSTRY CO., LTD., Minato-ku, Tokyo (JP)

(72) Inventors: Koichiro Akatsuka, Hashima-gun (JP); Tomoyuki Fujita, Kani-shi (JP); Masamichi Sugihara, Kani-shi (JP); Fumiyasu Kato, Kasugai-shi (JP)

(73) Assignee: KYB Corporation, Tokyo (JP)

( * ) Notice: Subject to any disclaimer, the term of this patent is extended or adjusted under 35 U.S.C. 154(b) by 62 days.

(21) Appl. No.: 14/386,427

(22) PCT Filed: Mar. 14, 2013

(86) PCT No.: PCT/JP2013/057148

§ 371 (c)(1),
(2) Date: Sep. 19, 2014

(87) PCT Pub. No.: WO2013/141129

PCT Pub. Date: Sep. 26, 2013

(65) Prior Publication Data

US 2015/0044083 A1 Feb. 12, 2015

(30) Foreign Application Priority Data

Mar. 21, 2012 (JP) ..... 2012-064133

(51) Int. Cl.
*F03C 4/00* (2006.01)
*F04C 2/00* (2006.01)
(Continued)

(52) U.S. Cl.
CPC ..... *F04C 14/226* (2013.01); *F04C 2/3442* (2013.01); *F04C 14/223* (2013.01); *F04C 28/24* (2013.01)

(58) Field of Classification Search
CPC .. F04C 14/226; F04C 14/223; F04C 2/3442; F04C 28/24
USPC ..... 418/24, 26–27, 30–31, 259, 261
See application file for complete search history.

(56) References Cited

U.S. PATENT DOCUMENTS

2005/0019174 A1* 1/2005 Uchino ..... F01C 21/0863 417/410.3
2007/0148029 A1* 6/2007 Yamamuro ..... F04C 14/226 418/30

(Continued)

FOREIGN PATENT DOCUMENTS

CN 101042133 A 9/2007
CN 101560975 A 10/2009

(Continued)

OTHER PUBLICATIONS

International Search Report and Written Opinion mailed Jun. 11, 2013, corresponding to International application No. PCT/JP2013/057148.

*Primary Examiner* — Theresa Trieu
(74) *Attorney, Agent, or Firm* — Hauptman Ham, LLP

(57) ABSTRACT

A variable capacity type vane pump with a first fluid pressure chamber and a second fluid pressure chamber provided at opposite sides of a pivot point of a cam ring includes a control valve for controlling a drive pressure of working fluid introduced from a pump chamber to the second fluid pressure chamber, a suction pressure of the working fluid sucked into the pump chamber is constantly introduced to the first fluid pressure chamber, and the cam ring pivots in a direction to decrease a discharge capacity due to a pressure in the pump chamber acting on an inner peripheral cam surface during an operation to reduce the drive pressure, whereas the cam ring pivots in a direction to increase the discharge capacity during an operation to increase the drive pressure.

3 Claims, 4 Drawing Sheets

(51) Int. Cl.

| | |
|---|---|
| ***F04C 14/18*** | (2006.01) |
| ***F04C 14/22*** | (2006.01) |
| ***F04C 2/344*** | (2006.01) |
| ***F04C 28/24*** | (2006.01) |

(56) References Cited

U.S. PATENT DOCUMENTS

2007/0212243 A1* 9/2007 Yamamuro ..... F04C 2/3442 418/30
2007/0224066 A1 9/2007 Yamamuro et al.
2009/0257899 A1 10/2009 Fujita et al.
2009/0291000 A1* 11/2009 Saga ..... F04C 2/3442 418/30
2015/0056090 A1* 2/2015 Akatsuka ..... F04C 2/344 418/29

FOREIGN PATENT DOCUMENTS

JP 200374479 A 3/2003
JP 200825423 A 2/2008
JP 20127513 A 1/2012

* cited by examiner

VARIABLE CAPACITY TYPE VANE PUMP

TECHNICAL FIELD

The present invention relates to a variable capacity type vane pump used as a fluid pressure supply source in a fluid pressure device.

BACKGROUND ART

A conventional variable capacity type vane pump is known which varies the eccentricity of a cam ring with respect to a rotor to vary a discharge capacity by pivoting the cam ring about a pin.

JP2003-74479A discloses a variable capacity type vane pump in which a first fluid pressure chamber, in which a fluid pressure is controlled by the operation of a control valve, is provided at one side in a pivoting direction of a cam ring and a second fluid pressure chamber, to which a suction side pressure is introduced, is provided at the other side. This variable capacity type vane pump is so designed that the cam ring pivots in a direction to decrease a discharge capacity if the fluid pressure in the first fluid pressure chamber is increased by the operation of the control valve.

SUMMARY OF INVENTION

In a variable capacity type vane pump used, for example, as a hydraulic pressure supply source for a power steering device, a continuously variable transmission or the like mounted in a vehicle, responsiveness to increase a discharge capacity is required so that a supplied hydraulic pressure does not become insufficient.

However, in the variable capacity type vane pump of JP2003-74479A, the suction side pressure is constantly introduced to the second fluid pressure chamber, and the cam ring pivots in the direction to increase the discharge capacity by a spring force of a spring for biasing the cam ring with a decrease in the pressure of the first fluid pressure chamber due to the operation of the control valve. Thus, there has been a problem of being difficult to ensure responsiveness to increase the discharge capacity.

The present invention was developed in view of the above problem and aims to provide a variable capacity type vane pump with ensured responsiveness to increase a discharge capacity.

A variable capacity type vane pump according to one aspect of the present invention is a variable capacity type vane pump used as a fluid pressure supply source and includes a rotor to be driven and rotated, a plurality of vanes reciprocally provided on the rotor, a cam ring having an inner peripheral cam surface, on which tip parts of the vanes slide with the rotation of the rotor, a pump chamber defined between adjacent vanes, a suction port for introducing working fluid sucked into the pump chamber, a discharge port for introducing the working fluid discharged from the pump chamber, a first fluid pressure chamber and a second fluid pressure chamber provided at opposite sides of a pivot point of the cam ring, and a control valve for controlling a drive pressure of the working fluid introduced from the pump chamber to the second fluid pressure chamber, wherein a suction pressure of the working fluid sucked into the pump chamber is constantly introduced to the first fluid pressure chamber, and the cam ring pivots in a direction to decrease a discharge capacity due to a pressure in the pump chamber acting on an inner peripheral cam surface of the cam ring during an operation to reduce the drive pressure, whereas the cam ring pivots in a direction to increase the discharge capacity during an operation to increase the drive pressure.

DESCRIPTION OF EMBODIMENTS

Figure 1:
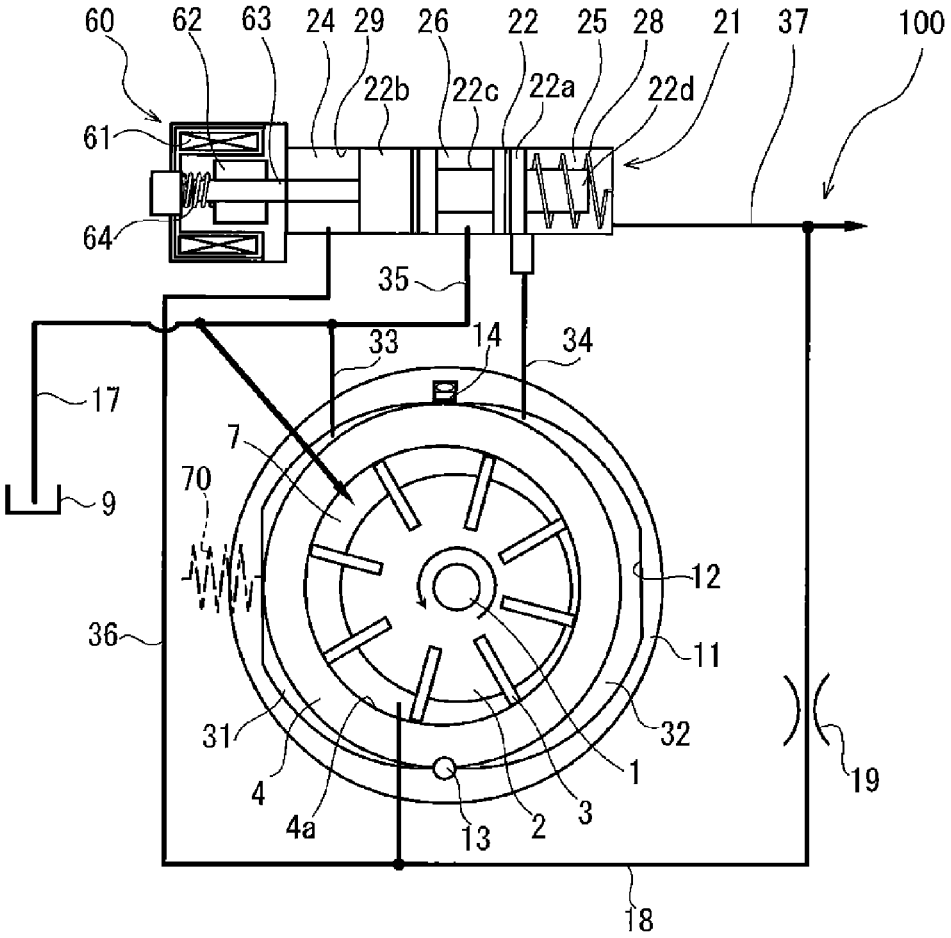
FIG. 1 is a configuration diagram of a variable capacity type vane pump according to an embodiment of the present invention.

Hereinafter, an embodiment of the present invention is described with reference to the drawings.

First, a variable capacity type vane pump 100 according to the embodiment of the present invention is described with reference to FIGS. 1 and 2.

The variable capacity type vane pump (hereinafter, referred to merely as a "vane pump") 100 is used as a hydraulic pressure (fluid pressure) supply source for a hydraulic device (fluid pressure device) mounted in a vehicle such as a power steering device or a continuously variable transmission.

The vane pump 100 is configured such that power of an engine (not shown) is transmitted to a drive shaft 1 to rotate a rotor 2 coupled to the drive shaft 1. In FIG. 1, the rotor 2 rotates counterclockwise as shown by an arrow.

The vane pump 100 includes a plurality of vanes 3 which are provided reciprocally movable in a radial direction relative to the rotor 2 and a cam ring 4 which houses the rotor 2 and can eccentrically move relative to a center of the rotor 2 and in which tip parts of the vanes 3 slides on an inner peripheral cam surface 4*a* on the inner periphery with the rotation of the rotor 2.

Figure 2:
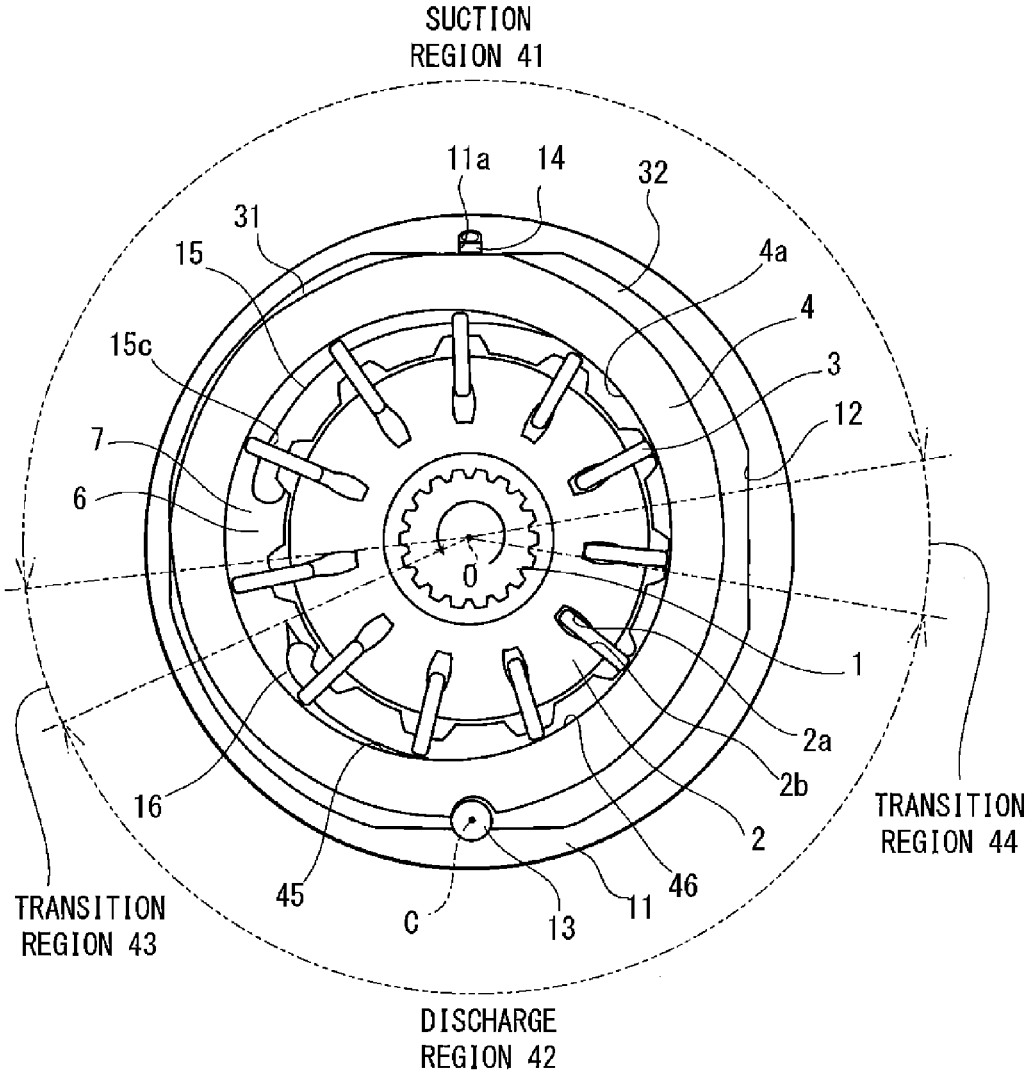
FIG. 2 is a front view of a rotor and the like showing the inside of the variable capacity type vane pump according to the embodiment of the present invention.

As shown in FIG. 2, the rotor 2 is formed with slits 2*b* including openings on the outer peripheral surface and radially arranged at predetermined intervals. The vanes 3 are slidably inserted into the slits 2*b*. Vane back pressure chambers 2*a* to which a pump discharge pressure is introduced are defined at base end sides of the slits 2*b*. The vanes 3 are pressed in a direction to project from the slits 2*b* by pressures in the vane back pressure chambers 2*a*.

The drive shaft 1 is rotatably supported on a pump body (not shown). The pump body is formed with a pump housing recess for housing the cam ring 4. A side plate 6 held in contact with one lateral part of the rotor 2 and the cam ring 4 is arranged on the bottom surface of the pump housing recess. An opening of the pump housing recess is sealed by a pump cover (not shown) held in contact with the other lateral part of the rotor 2 and the cam ring 4. The pump cover and the side plate 6 are arranged to sandwich opposite side surfaces of the rotor 2 and the cam ring 4. A pump chamber 7 partitioned by each vane 3 is defined between the rotor 2 and the cam ring 4.

The cam ring 4 is an annular member and includes, on the inside thereof, a suction region 41 formed to correspond to a suction port 15 to be described later and configured to expand the capacity of the pump chamber 7 with the rotation of the rotor 2, a discharge region 42 formed to correspond to a discharge port to be described later and configured to contract the capacity of the pump chamber 7 with the rotation of the rotor 2, and transition regions 43, 44 configured to trap hydraulic oil (working fluid) in the pump chamber 7. The pump chamber 7 sucks the hydraulic oil in the suction region 41 and discharges the hydraulic oil in the discharge region 42.

Figure 3:
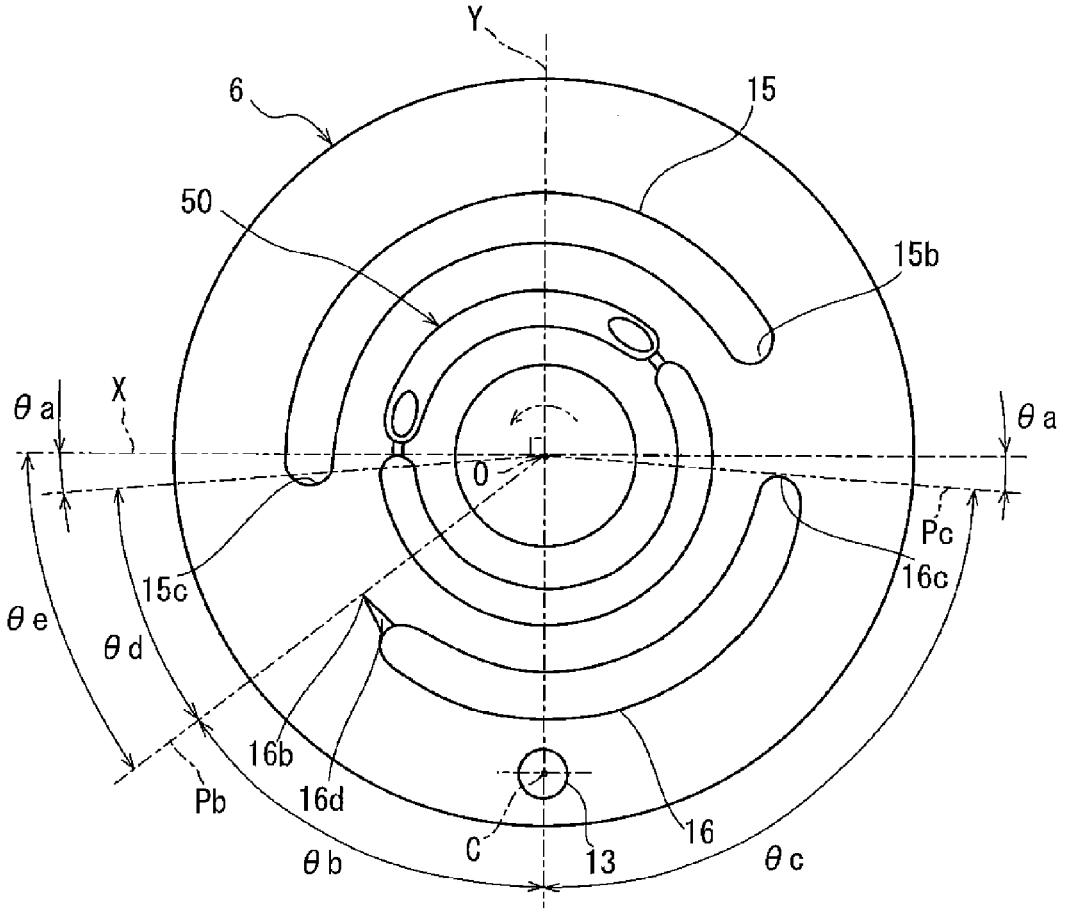
FIG. 3 is a front view of a side plate in the variable capacity type vane pump according to the embodiment of the present invention.

As shown in FIG. 3, the side plate 6 is formed with the suction port 15 for introducing the hydraulic oil into the pump chamber 7 and the discharge port 16 for taking out the hydraulic oil in the pump chamber 7 and introducing it to the hydraulic device. Specific shapes of the suction port 15 and the discharge port 16 are described in detail later.

The unillustrated pump cover is also formed with a suction port and a discharge port. The suction port and the discharge port of the pump cover respectively communicate with the suction port 15 and the discharge port 16 of the side plate 6 via the pump chamber 7.

As shown in FIG. 1, the pump chamber 7 in the suction region 41 communicates with a tank 9 via a suction passage 17 and the hydraulic oil in the tank 9 is supplied to the pump chamber 7 through the suction port 15 via the suction passage 17.

The pump chamber 7 in the discharge region 42 communicates with a discharge passage 18 and the hydraulic oil discharged from the discharge port 16 is supplied to the hydraulic device (not shown) outside the vane pump 100 through the discharge passage 18.

The discharge passage 18 communicates with a back pressure passage 50 formed in the side plate 6 (see FIG. 3) and the hydraulic oil discharged from the discharge port 16 is supplied to the vane back pressure chambers 2*a*. The vanes 3 are pressed in a direction to project from the rotor 2 toward the cam ring 4 by the hydraulic oil in the vane back pressure chambers 2*a*.

When the vane pump 100 operates, the vanes 3 are biased in the direction to project from the slits 2*b* by hydraulic oil pressures in the vane back pressure chambers 2*a* pressing base end parts of the vanes 3 and a centrifugal force acting with the rotation of the rotor 2, and tip parts thereof slide in contact with the inner peripheral cam surface 4*a* of the cam ring 4. In the suction region 41 of the cam ring 4, the vanes 3 sliding in contact with the inner peripheral cam surface 4*a* project from the rotor 2 to expand the pump chamber 7 and the hydraulic oil is sucked into the pump chamber 7 through the suction port 15. In the discharge region 42 of the cam ring 4, the vanes 3 sliding in contact with the inner peripheral cam surface 4*a* are pushed into the rotor 2 to contract the pump chamber 7 and the hydraulic oil pressurized in the pump chamber 7 is discharged from the discharge port 16.

A configuration for varying a discharge capacity (displacement volume) of the vane pump 100 is described below.

The vane pump 100 includes an annular adapter ring 11 surrounding the cam ring 4. A support pin 13 is interposed between the adapter ring 11 and the cam ring 4. The cam ring 4 is supported on the support pin 13 and pivots about the support pin 13 inside the adapter ring 11 and eccentrically moves relative to a center O of the rotor 2. The center of this support pin 13 corresponds to a pivot point C of the cam ring 4.

A seal member 14 with which the outer peripheral surface of the cam ring 4 slides in contact when the cam ring 4 pivots is disposed in a groove 11*a* of the adapter ring 11. A first fluid pressure chamber 31 and a second fluid pressure chamber 32 are defined between the outer peripheral surface of the cam ring 4 and the inner peripheral surface of the adapter ring 11 by the support pin 13 and the seal member 14. In other words, the first and second fluid pressure chambers 31, 32 are provided at opposite sides of the pivot point C of the cam ring 4.

The cam ring 4 pivots about the pivot point C due to a pressure balance of the first fluid pressure chamber 31, the second fluid pressure chamber 32 and the pump chamber 7. By a pivoting movement of the cam ring 4, the eccentricity of the cam ring 4 with respect to the rotor 2 varies and the discharge capacity of the pump chamber 7 varies. If the cam ring 4 pivots to the right side in FIG. 1, the eccentricity of the cam ring 4 with respect to the rotor 2 decreases and the discharge capacity of the pump chamber 7 decreases. Contrary to this, if the cam ring 4 pivots to the left side in FIG. 1, the eccentricity of the cam ring 4 with respect to the rotor 2 increases and the discharge capacity of the pump chamber 7 increases.

A first fluid pressure passage 33 is connected to the first fluid pressure chamber 31, which communicates with the suction passage 17 via the first fluid pressure passage 33, and a suction pressure produced in the suction passage 17 is introduced to the first fluid pressure chamber 31.

A second fluid pressure passage 34 is connected to the second fluid pressure chamber 32 and a control valve 21 is disposed in the second fluid pressure passage 34. The control valve 21 controls a drive pressure introduced to the second fluid pressure passage 32 to drive the cam ring 4.

An orifice 19 is disposed in the discharge passage 18 and the control valve 21 is operated by a pressure difference before and after the orifice 19. It should be noted that the orifice 19 may be either of a variable type or of a fixed type as long as resistance is applied to the flow of the hydraulic oil discharged from the pump chamber 7.

The control valve 21 includes a spool 22 slidably inserted into a valve housing hole 29, a first spool chamber 24 defined between one end of the spool 22 and the valve housing hole 29, a third spool chamber 25 defined between the other end of the spool 22 and the valve housing hole 29, a second spool chamber 26 defined between an annular groove 22*c* and the valve housing hole 29, a return spring 28 housed in the third spool chamber 25 and configured to bias the spool 22 in a direction to expand the volume of the third spool chamber 25, and a solenoid 60 configured to drive the spool 22 against the return spring 28.

The solenoid 60 includes a plunger 62 to be driven by a magnetic field generated in a coil 61, a shaft 63 coupling the plunger 62 and the spool 22 and an auxiliary spring 64 configured to bias the shaft 63 in an axial direction.

In the solenoid 60, an excitation current of the coil 61 is controlled by an unillustrated controller and the spool 22 moves in the axial direction according to the excitation current.

The spool 22 includes a first land portion 22*a* and a second land portion 22*b* which slide along the inner peripheral surface of the valve housing hole 29, the annular groove 22*c* formed between the first and second land portions 22*a*, 22*b*, and a stopper portion 22*d* projecting from one end of the first land portion 22*a*. A moving range of the spool 22 is restricted by the contact of the stopper portion 22*d* with a bottom part of the valve housing hole 29.

The discharge passage 18 communicates with the first spool chamber 24 via a pressure introducing passage 36 and a pump discharge pressure upstream of the orifice 19 is introduced to the first spool chamber 24.

The suction passage 17 communicates with the second spool chamber 26 and the suction pressure in the suction passage 17 is introduced to the second spool chamber 26.

The discharge passage 18 communicates with the third spool chamber 25 via a pressure introducing passage 37 and the pump discharge pressure downstream of the orifice 19 is introduced to the third spool chamber 25.

The spool 22 moves to and stops at a position where a load due to the pressure difference before and after the orifice 19 introduced to the first and third spool chambers 24, 25 defined on both ends, a biasing force of the return spring 28 and a drive force of the solenoid 60 are balanced. Depending on the position of the spool 22, the second fluid pressure passage 34 is opened and closed to the second spool chamber 26 (pressure introducing passage 35) and the third spool chamber 25 (pressure introducing passage 37) by the first land portion 22*a* and the hydraulic oil is supplied into and discharge from the second fluid pressure chamber 32.

When the rotor 2 rotates at a low speed, a total load of a load due to a pressure in the third spool chamber 25 and the biasing force of the return spring 28 becomes larger than that of a pressure in the first spool chamber 24 and the drive force of the solenoid 60, the return spring 28 extends and the spool 22 moves to the left side in FIG. 1 since the pressure difference before and after the orifice 19 is smaller than a predetermined value set in advance. In this state, as shown in FIG. 1, the second fluid pressure passage 34 communicates with the third spool chamber 25 and the pump discharge pressure in the discharge passage 18 is introduced to the second fluid pressure chamber 32 via the second fluid pressure passage 34, the third spool chamber 25 and the pressure introducing passage 37. On the other hand, the suction pressure is introduced to the first fluid pressure chamber 31 via the first fluid pressure passage 33. Thus, a pressure difference corresponding to the pump discharge pressure downstream of the orifice 19 is produced between the first and second fluid pressure chambers 31, 32.

As just described, in an operating state where there is a pressure difference between the first and second fluid pressure chambers 31, 32, as shown in FIGS. 1 and 2, the cam ring 4 is moved to the left side in FIGS. 1 and 2 and comes into contact with the adapter ring 11 to maximize the discharge capacity of the pump chamber 7.

If the rotation speed of the rotor 2 increases and the pressure difference before and after the orifice 19 increases beyond the predetermined value set in advance, a total load of the pressure in the first spool chamber 24 and the drive force of the solenoid 60 becomes larger than that of the load due to the pressure in the third spool chamber 25 and the biasing force of the return spring 28, the return spring 28 contracts and the spool 22 moves to the right side in FIG. 1. In this state, the second fluid pressure passage 34 communicates with the second spool chamber 26 via an unillustrated throttle (notch) and also communicates with the third spool chamber 25. As a result, a control pressure between the pump discharge pressure in the discharge passage 18 and the suction pressure in the suction passage 17 is introduced to the second fluid pressure chamber 32. On the other hand, the suction pressure is introduced to the first fluid pressure chamber 31 through the first fluid pressure passage 33. Thus, the pressure difference between the first and second fluid pressure chambers 31, 32 is adjusted according to a stroke position of the spool 22.

As just described above, the control valve 21 adjusts the pressure in the second fluid pressure chamber 32 according to the pressure difference before and after the orifice 19, the cam ring 4 pivots to a position where a load due to the pressure difference between the first and second fluid pressure chambers 31, 32 acting on the outer peripheral surface of the cam ring 4 and a load due to an inner pressure acting on the inner peripheral cam surface 4*a* of the cam ring 4 as described later are balanced, and the discharge capacity of the pump chamber 7 is adjusted. Then, the unillustrated controller controls the excitation current of the solenoid 60, thereby the eccentric position of the cam ring 4 is changed and the discharge capacity of the pump chamber 7 is controlled.

A restricting portion 12 for restricting a movement of the cam ring 4 in a direction to decrease the eccentricity with respect to the rotor 2 is formed to bulge out on the inner peripheral surface of the adapter ring 11 in the second fluid pressure chamber 32. The restricting portion 12 is for specifying a minimum eccentricity of the cam ring 4 with respect to the rotor 2 and maintains a deviated state of the center O of the rotor 2 and the center of the cam ring 4 with the outer peripheral surface of the cam ring 4 held in contact with the restricting portion 12.

The restricting portion 12 is for guaranteeing a minimum discharge capacity of the pump chamber 7 so that the eccentricity of the cam ring 4 with respect to the rotor 2 does not become zero. That is, the restricting portion 12 is so formed that the minimum eccentricity of the cam ring 4 with respect to the rotor 2 is ensured and the pump chamber 7 can discharge the hydraulic oil even in a state where the outer peripheral surface of the cam ring 4 is held in contact.

It should be noted that the restricting portion 12 may be formed on the outer peripheral surface of the cam ring 4 in the second fluid pressure chamber 32 instead of being formed on the inner peripheral surface of the adapter ring 11. Further, if the adapter ring 11 is not provided, the restricting portion 12 may be formed on the inner peripheral surface of the pump housing recess of the pump body (not shown) for housing the cam ring 4.

The inner peripheral cam surface 4*a* of the cam ring 4 is configured to apply a force for pivoting the cam ring 4 in a direction to decrease the discharge capacity upon being subjected to the pressure in the pump chamber 7 (inner pressure of the cam ring 4) to the cam ring 4. The discharge port 16 and the suction port 15 are so arranged with respect to the pivot point C of the cam ring 4 that a load acting on the inner peripheral cam surface 4*a* of the cam ring 4 due to the pressure in the pump chamber 7 is constantly biased toward the second fluid pressure chamber 32 with respect to the pivot point C regardless of the rotational position of the rotor 2. This causes the vane pump 100 to be configured not to include a spring for biasing the cam ring 4 unlike conventional devices such as the one disclosed in JP2003-74479A.

The discharge port 16 and the suction port 15 according to the embodiment of the present invention are described below with reference to FIGS. 3 to 5.

First, the shapes of the discharge port 16 and the suction port 15 are described.

As shown in FIG. 3, each of the suction port 15 and the discharge port 16 is formed into an arcuate shape in conformity with the shape of the inner peripheral cam surface 4*a*. The suction port 15 and the discharge port 16 are formed into arcuate shapes extending along the inner peripheral cam surface 4*a* in a state where the center of the cam ring 4 and the center O of the rotor 2 coincide, i.e. in a state where the eccentricity of the cam ring 4 is zero.

The suction port 15 includes a start edge 15*b* and an end edge 15*c* on opposite ends thereof. With the rotation of the rotor 2, the pump chamber 7 faces the start edge 15*b*, thereby starting a communicating state between the pump chamber 7 and the suction port 15. When the pump chamber 7 passes over a position where it faces the end edge 15*c*, the communicating state between the pump chamber 7 and the suction port 15 is finished.

The discharge port 16 includes a start edge 16*b* and an end edge 16*c* on opposite ends thereof. With the rotation of the rotor 2, the pump chamber 7 faces the start edge 16*b*, thereby starting a communicating state between the pump chamber 7 and the discharge port 16. When the pump chamber 7 passes over a position where it faces the end edge 16*c*, the communicating state between the pump chamber 7 and the discharge port 16 is finished.

A notch 16*d* is formed on one end of the discharge port 16 and the tip of this notch 16*d* serves as the start edge 16*b* of the discharge port 16. The notch 16*d* is a groove whose cross-sectional area gradually decreases. It should be noted that the discharge port 16 may exclude the notch 16*d* without being limited to the aforementioned configuration.

Here, each part of the vane pump 100 is called as follows.

A virtual line (straight line) connecting the pivot point C of the cam ring 4 and the rotation center O of the rotor 2 is a pivot center line Y.

A virtual line (straight line) connecting the rotation center O of the rotor 2 and the start edge 16*b* of the discharge port 16 is a discharge port start edge line Pb.

An angle of inclination of the discharge port start edge line Pb with respect to the pivot center line Y is a discharge port start edge line inclination angle θb.

A virtual line (straight line) connecting the rotation center O of the rotor 2 and the end edge 16*c* of the discharge port 16 is a discharge port end edge line Pc.

An angle of inclination of the discharge port end edge line Pc with respect to the pivot center line Y is a discharge port end edge line inclination angle θc.

An angle of intersection between center lines of adjacent vanes 3 is a vane angle θd.

The discharge port start edge line inclination angle θb is smaller than the discharge port end edge line inclination angle θc and a difference θc−θb between the both angles is larger than the vane angle θd, i.e. θc−θb>θd. Specifically, the discharge port 16 is so formed that the discharge port end edge line inclination angle θc is larger than the sum of the discharge port start edge line inclination angle θb and the vane angle θd. This causes a load acting on the cam ring 4 due to the pressure in the pump chamber 7 to be constantly biased toward the second fluid pressure chamber 32 (right side in FIG. 3) with respect to the pivot point C.

If a virtual line perpendicular to the pivot center line Y of the cam ring 4 and intersecting with the rotation center O of the rotor 2 is an equilibrium line X and an angle of inclination of the discharge port end edge line Pc with respect to the equilibrium line X is an angle θa, an angle θe of inclination of the discharge port start edge line Pb with respect to the equilibrium line X is larger than the sum of the vane angle θd and the angle θa.

As shown in FIG. 2, the inner peripheral cam surface 4*a* in the discharge region 42 includes a first pressure receiving portion 45 on which a pressure acts to eccentrically move the cam ring 4 in the direction to increase the discharge capacity discharged from the pump chamber 7 and a second pressure receiving portion 46 on which a pressure acts to eccentrically move the cam ring 4 in the direction to decrease the discharge capacity discharged from the pump chamber 7.

The first pressure receiving portion 45 is provided to face the pump chamber 7 at the side of the first fluid pressure chamber 31 (left side in FIG. 2) with respect to the support pin 13 on the inner periphery of the cam ring 4. Due to the pressure in the pump chamber 7 acting on the first pressure receiving portion 45, a force acts on the cam ring 4 to pivot the cam ring 4 in the direction to increase the discharge capacity discharged from the pump chamber 7 (to the left side in FIG. 2).

The second pressure receiving portion 46 is provided to face the pump chamber 7 at the side of the second fluid pressure chamber 32 (right side in FIG. 2) with respect to the support pin 13 on the inner periphery of the cam ring 4. The second pressure receiving portion 46 is formed to be continuous with the first pressure receiving portion 45 at the opposite sides of a position on the inner peripheral cam surface 4*a* corresponding to the support pin 13. Due to the pressure in the pump chamber 7 acting on the second pressure receiving portion 46, a force acts on the cam ring 4 to pivot the cam ring 4 in the direction to decrease the discharge capacity discharged from the pump chamber 7 (to the right side in FIG. 2).

Thus, a force acts to pivot the cam ring 4 toward one side by a product of the pressure acting on the first pressure receiving portion 45 and a pressure receiving area of the first pressure receiving portion 45 and a force acts to pivot the cam ring 4 toward the other side by a product of the pressure acting on the second pressure receiving portion 46 and a pressure receiving area of the second pressure receiving portion 46.

Here, since the pump chamber 7 in the discharge region 42 communicates via the discharge port 16, the pressure in the pump chamber 7 in the discharge region 42 is substantially constant. Thus, if the pressure receiving areas of the first and second pressure receiving portions 45, 46 differ, the force acting on the pressure receiving portion having a larger pressure receiving area becomes larger than the force acting on the pressure receiving portion having a smaller pressure receiving area in the cam ring 4. Therefore, the cam ring 4 pivots about the support pin 13 toward one of the first and second pressure receiving portions 45, 46 having the larger pressure receiving area.

The pressure receiving areas of the first and second pressure receiving portions 45, 46 vary according to the rotational position of the rotor 2 (position of the pump chamber 7), but the load acting on the cam ring 4 due to the pressure in the pump chamber 7 is constantly biased toward the second fluid pressure chamber 32 with respect to the pivot point C by setting a minimum value of the pressure receiving area of the second pressure receiving portion 46 larger than a maximum value of the pressure receiving area of the first pressure receiving portion 45.

Figure 4:
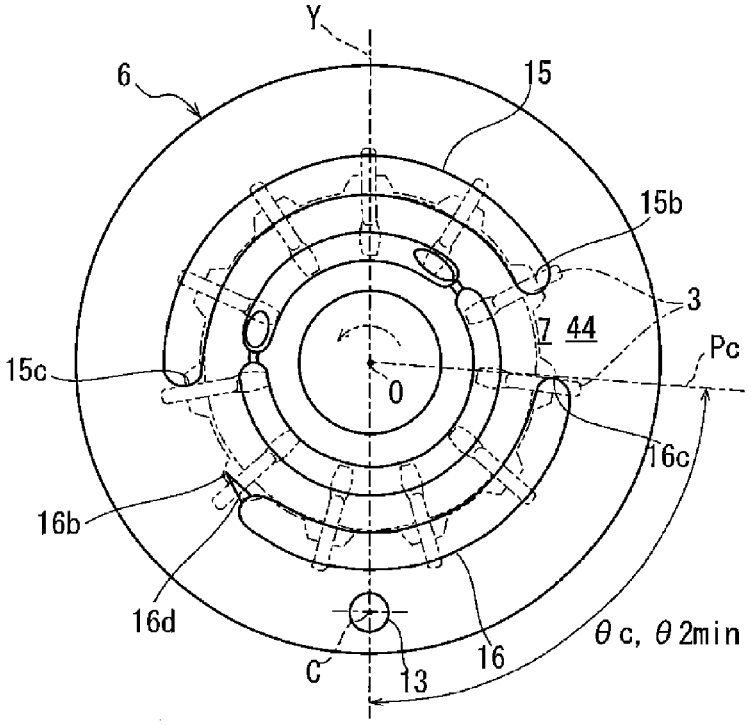
FIG. 4 is a front view showing a distribution range of a first pressure receiving portion in the variable capacity type vane pump according to the embodiment of the present invention.

FIG. 4 shows a rotational position of the rotor 2 where the pressure receiving area of the second pressure receiving portion 46 is minimum. At this rotational position of the rotor 2, the pump chamber 7 located between the end edge 16*c* of the discharge port 16 and the start edge 15*b* of the suction port 15 passes the transition region 44 of the cam ring 4 and a discharge pressure trapped in this pump chamber 7 is introduced to the suction port 15. Accordingly, an angle range of the second pressure receiving portion 46 in this state becomes a minimum angle range θ2min of the second pressure receiving portion 46. This minimum angle range θ2min of the second pressure receiving portion 46 coincides with the aforementioned discharge port end edge line inclination angle θc.

Figure 5:
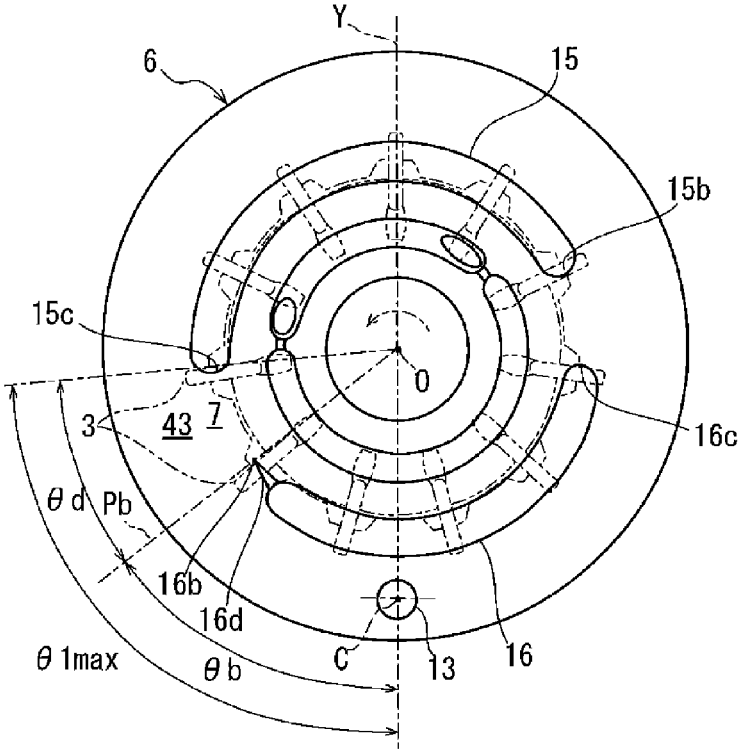
FIG. 5 is a front view showing a distribution range of a second pressure receiving portion in the variable capacity type vane pump according to the embodiment of the present invention.

FIG. 5 shows a rotational position of the rotor 2 where the pressure receiving area of the first pressure receiving portion 45 is maximum. At this rotational position of the rotor 2, the pump chamber 7 located between the end edge 15*c* of the suction port 15 and the start edge 16*b* of the discharge port 16 passes the transition region 43 of the cam ring 4 and a discharge pressure of the discharge port 16 is introduced to the pump chamber 7. Accordingly, an angle range of the first pressure receiving portion 45 where the pump chamber 7 communicating with the discharge port 16 is located in this state becomes a maximum angle range θ1max of the first pressure receiving portion 45. This maximum angle range θ1max of the first pressure receiving portion 45 coincides with the aforementioned sum of the discharge port start edge line inclination angle θb and the vane angle θd.

Accordingly, the aforementioned discharge port end edge line inclination angle θc only has to be set larger than the sum of the discharge port start edge line inclination angle θb and the vane angle θd to set the minimum angle range θ2min of the second pressure receiving portion 46 larger than the maximum angle range θ1max of the first pressure receiving portion 45. Specifically, the minimum value of the pressure receiving area of the second pressure receiving portion 46 becomes larger than the maximum value of the pressure receiving area of the first pressure receiving portion 45 by setting a relationship of θc>θb+θd and the load acting on the cam ring 4 due to the pressure in the pump chamber 7 can be constantly biased toward the second fluid pressure chamber 32 with respect to the pivot point C regardless of the rotational position of the rotor 2.

The operation of the vane pump 100 is described below.

Since the movement of the cam ring 4 is so restricted by the restricting portion 12 that the eccentricity of the cam ring 4 with respect to the rotor 2 does not become zero when the vane pump 100 is started, the vanes 3 reciprocate with the rotation of the rotor 2 and a force is generated to press the cam ring 4 toward the second fluid pressure chamber 32 (right side in FIG. 2) due to the increasing pressure in the pump chamber 7.

During the operation at a low rotation speed of the rotor 2, the drive pressure introduced to the second fluid pressure chamber 32 is increased by the control valve 21. This makes the load due to the pressure difference between the first and second fluid pressure chambers 31, 32 acting on the outer peripheral surface of the cam ring 4 larger than the load due to the pressure in the pump chamber 7 acting on the first and second pressure receiving portions 45, 46 of the cam ring 4 and, as shown in FIG. 1, the cam ring 4 moves toward the first fluid pressure chamber 31 of the pump chamber 7 and is held at a position in contact with the adapter ring 11 to maximize the discharge capacity.

If the rotation speed of the rotor 2 increases beyond a predetermined value, the drive pressure introduced to the second fluid pressure chamber 32 is decreased by the control valve 21. This makes the load due to the pressure in the pump chamber 7 acting on the first and second pressure receiving portions 45, 46 of the cam ring 4 larger than the load due to the pressure difference between the first and second fluid pressure chambers 31, 32 acting on the outer peripheral surface of the cam ring 4 and the cam ring 4 is pivoted toward the second fluid pressure chamber 32 (right side in FIGS. 1 and 2). This gradually decreases the discharge capacity with an increase in the rotation speed of the rotor 2.

On the other hand, if the drive pressure introduced to the second fluid pressure chamber 32 is increased by the control valve 21 during an operation to largely switch the discharge capacity, the cam ring 4 quickly pivots to increase the discharge capacity due to the pressure difference between the first and second fluid pressure chambers 31, 32 acting on the outer peripheral surface of the cam ring 4 since the suction pressure is introduced to the first fluid pressure chamber 31.

Since the cam ring 4 pivots in the direction to increase the discharge capacity due to an increase in the drive pressure introduced to the second fluid pressure chamber 32 in the vane pump 100 as described above, responsiveness to increase the discharge capacity is enhanced as compared with conventional devices (see JP2003-74479A) in which a control valve reduces a pressure in a fluid pressure chamber, whereby a cam ring pivots in a direction to increase a discharge capacity due to a spring force of a spring for biasing the cam ring. In this way, it is avoided that the amount of the hydraulic oil supplied from the vane pump 100 to the hydraulic device becomes insufficient.

According to the above embodiment, the following functions and effects can be achieved.

[1] The variable capacity type vane pump 100 with the first and second fluid pressure chambers 31, 32 provided at the opposite sides of the pivot point C of the cam ring 4 is provided with the control valve 21 for controlling a drive pressure of working fluid introduced from the pump chamber 7 to the second fluid pressure chamber 32, a suction pressure of the working fluid sucked into the pump chamber 7 is constantly introduced to the first fluid pressure chamber 31, and the cam ring 4 pivots in the direction to decrease the discharge capacity due to the pressure in the pump chamber 7 acting on the inner peripheral cam surface 4*a* during an operation to reduce the drive pressure, whereas the cam ring 4 pivots in the direction to increase the discharge capacity during an operation to increase the drive pressure. Thus, responsiveness to increase the discharge capacity is enhanced as compared with conventional devices (see JP2003-74479A) in which a cam ring pivots in a direction to increase a discharge capacity due to a spring force of a spring for biasing the cam ring and it is avoided that the amount of the working fluid supplied from the vane pump 100 becomes insufficient.

[2] The inner peripheral cam surface 4*a* in the discharge region includes the first pressure receiving portion 45 on which the pressure of the working fluid for eccentrically moving the cam ring 4 in the direction to increase the discharge capacity discharged from the pump chamber 7 acts and the second pressure receiving portion 46 on which the pressure of the working fluid for eccentrically moving the cam ring 4 in the direction to decrease the discharge capacity discharged from the pump chamber 7 acts, and the discharge port 16 is so formed that the discharge port end edge line inclination angle θc is larger than the sum θb+θd of the discharge port start edge line inclination angle θb and the vane angle θd. Thus, the minimum value of the pressure receiving area of the second pressure receiving portion 46 becomes larger than the maximum value of the pressure receiving area of the first pressure receiving portion 45 and a force for biasing the cam ring 4 in the direction toward the second fluid pressure chamber 32 can be stably obtained by the pressure in the pump chamber 7. Since this enables a spring for biasing the cam ring 4 in the direction toward the second fluid pressure chamber 32 to be dispensed with, it is not necessary to provide the pump body with a hole or the like used to mount the spring, the structure of the vane pump 100 is simplified and manufacturing cost is suppressed.

It should be noted that the vane pump 100 may be configured to include a spring 70 for biasing the cam ring 4 toward the second fluid pressure chamber 32 as shown in chain double-dashed line in FIG. 1. Since the cam ring 4 is pivoted in the direction to decrease the discharge capacity by a spring force of the spring 70 and the pressure in the pump chamber 7 acting on the inner peripheral cam surface 4*a* in this case, responsiveness to decrease the discharge capacity is enhanced.

[3] Since the restricting portion 12 for restricting the movement of the cam ring 4 is provided so that the eccentricity of the cam ring 4 with respect to the rotor 2 does not become zero, a force for biasing the cam ring 4 toward one of the first and second fluid pressure chambers 31, 32 is obtained by the pressure in the pump chamber 7 and the spring for biasing the cam ring 4 can be dispensed with.

Although the embodiment of the present invention has been described above, the above embodiment is merely an illustration of an application example of the present invention and not intended to limit the technical scope of the present invention to the specific configuration of the above embodiment.

This application claims a priority based on Japanese Patent Application 2012-64133 filed with the Japan Patent Office on Mar. 21, 2012, all the contents of which are incorporated therein by reference.

The invention claimed is:

1. A variable capacity type vane pump configured as a fluid pressure supply source, the vane pump comprising:

a rotor to be driven and rotated;

a plurality of vanes reciprocally provided on the rotor;

a cam ring having an inner peripheral cam surface, on which tip parts of the plurality of vanes are slidable when the rotor is rotated;

a pump chamber defined between adjacent vanes among the plurality of vanes;

a suction port configured to introduce working fluid sucked into the pump chamber;

a discharge port configured to introduce the working fluid discharged from the pump chamber;

a first fluid pressure chamber and a second fluid pressure chamber provided at opposite sides of a pivot point of the cam ring; and a control valve configured to control a drive pressure of the working fluid introduced from the pump chamber to the second fluid pressure chamber by a drive force of a solenoid connected to the control valve, the control valve comprising a spool configured to be driven by the solenoid;

wherein a suction pressure of the working fluid sucked into the pump chamber is constantly introduced to the first fluid pressure chamber, and the cam ring pivots in a direction to decrease a discharge capacity due to a pressure in the pump chamber acting on the inner peripheral cam surface of the cam ring during an operation to reduce the drive pressure, whereas the cam ring pivots in a direction to increase the discharge capacity during an operation to increase the drive pressure.

2. The variable capacity type vane pump according to claim 1, further comprising:

a restricting portion configured to restrict a movement of the cam ring so that the eccentricity of the cam ring with respect to the rotor does not become zero.

3. A variable capacity type vane pump configured as a fluid pressure supply source, the vane pump comprising:

a rotor to be driven and rotated;

a plurality of vanes reciprocally provided on the rotor;

a cam ring having an inner peripheral cam surface, on which tip parts of the plurality of vanes are slidable when the rotor is rotated;

a pump chamber defined between adjacent vanes among the plurality of vanes;

a suction port configured to introduce working fluid sucked into the pump chamber;

a discharge port configured to introduce the working fluid discharged from the pump chamber;

a first fluid pressure chamber and a second fluid pressure chamber provided at opposite sides of a pivot point of the cam ring; and a control valve configured to control a drive pressure of the working fluid introduced from the pump chamber to the second fluid pressure chamber by a drive force of a solenoid connected to the control valve;

wherein a suction pressure of the working fluid sucked into the pump chamber is constantly introduced to the first fluid pressure chamber, the cam ring pivots in a direction to decrease a discharge capacity due to a pressure in the pump chamber acting on the inner peripheral cam surface of the cam ring during an operation to reduce the drive pressure, whereas the cam ring pivots in a direction to increase the discharge capacity during an operation to increase the drive pressure, a virtual line connecting the pivot point of the cam ring and a rotation center of the rotor is a pivot center line, a virtual line connecting the rotation center of the rotor and a start edge of the discharge port is a discharge port start edge line, an angle of inclination of the discharge port start edge line with respect to the pivot center line is a discharge port start edge line inclination angle, a virtual line connecting the rotation center of the rotor and an end edge of the discharge port is a discharge port end edge line, an angle of inclination of the discharge port end edge line with respect to the pivot center line is a discharge port end edge line inclination angle, an angle of intersection between center lines of adjacent vanes among the plurality of vanes is a vane angle, and the discharge port end edge line inclination angle is larger than a sum of the discharge port start edge line inclination angle and the vane angle.

* * * * *